United States Patent [19]

Horster

[11] 4,126,520

[45] Nov. 21, 1978

[54] LIFT-OFF DEVICE FOR OVEN CHAMBER DOORS OF A COKE OVEN

[75] Inventor: Lothar Hörster, Solingen, Fed. Rep. of Germany

[73] Assignee: Hartung, Kuhn & Co Maschinenfabrik GmbH, Düsseldorf, Fed. Rep. of Germany

[21] Appl. No.: 902,036

[22] Filed: May 2, 1978

[30] Foreign Application Priority Data

May 6, 1977 [DE] Fed. Rep. of Germany ..... 2720469

[51] Int. Cl.[2] ..... C10B 25/14

[52] U.S. Cl. ..... 202/248; 212/4

[58] Field of Search ..... 202/241, 242, 248; 212/4; 110/277

[56] References Cited

U.S. PATENT DOCUMENTS

| | | | |
|---|---|---|---|
| 2,182,494 | 12/1939 | Lavely | 212/4 |
| 2,972,422 | 2/1961 | Stone | 212/4 |
| 3,451,898 | 6/1969 | Presti et al. | 202/248 |

FOREIGN PATENT DOCUMENTS

| | | | |
|---|---|---|---|
| 259,039 | 12/1968 | U.S.S.R. | 202/248 |

*Primary Examiner*—Morris O. Wolk
*Assistant Examiner*—Roger F. Phillips
*Attorney, Agent, or Firm*—Dressler, Goldsmith, Clement, Gordon & Shore, Ltd.

[57] ABSTRACT

A lift-off device for the door of oven chambers including a mechanism for gripping the door and counter mechanisms for measuring the movement of the doors to insure that the doors once removed will be accurately and positively repositioned relative to the oven chamber.

6 Claims, 2 Drawing Figures

LIFT-OFF DEVICE FOR OVEN CHAMBER DOORS OF A COKE OVEN

Figure 1:
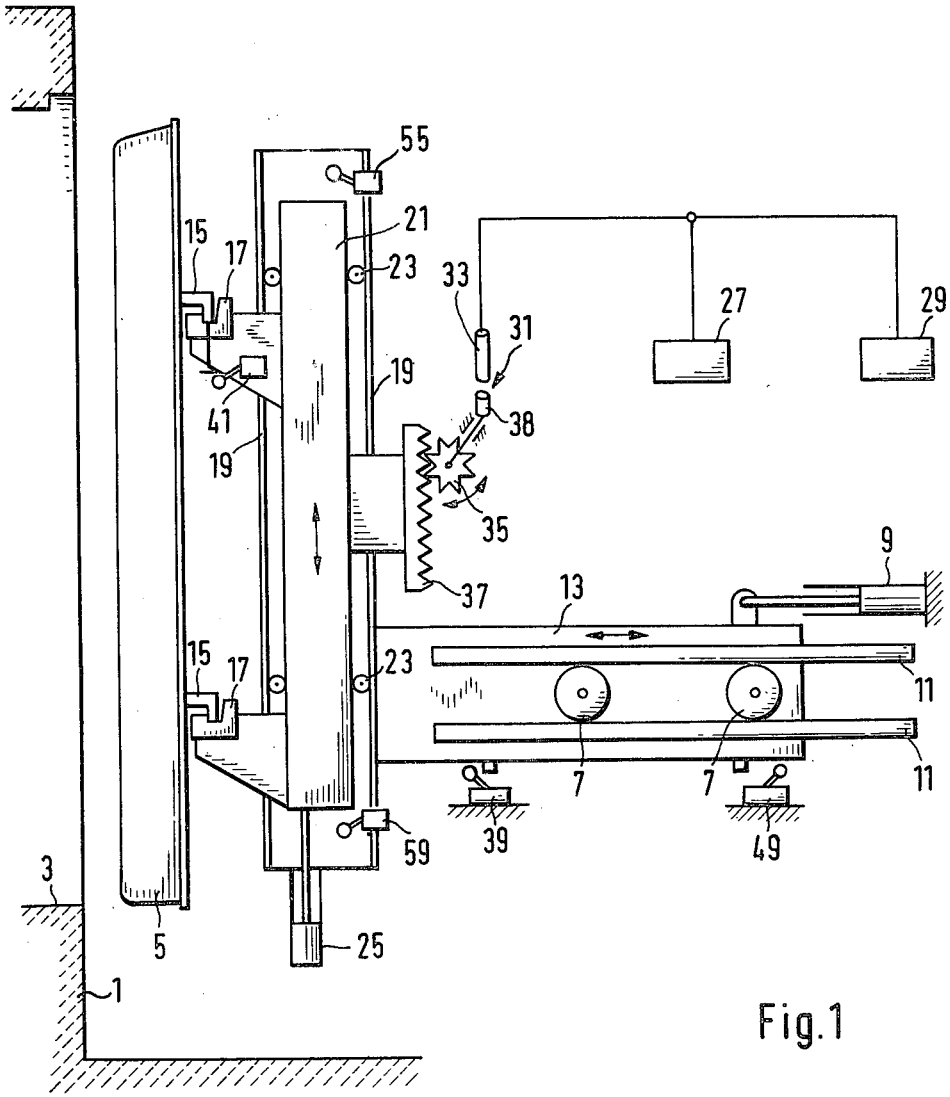

The invention relates to a lift-off device for the doors of oven chambers of a horizontal chamber coke oven, in which the lift-off claws can be raised and lowered between a bottom and a top terminal position and can be moved, in an intermediate engagement position, in the direction of the longitudinal axis of the oven chambers.

Well-insulating oven chamber doors of coke ovens engage in the oven chamber. Since they are not connected to the coke oven by hinges, they are drawn out of the oven chamber, or inserted into the chamber, by means of a lift-off device. The lift-off device is not constantly connected to the door but is only moved up to the door, and coupled thereto, when the door requires opening. For this purpose, lift-off claws are provided on the lift-off device, and engage with the door. For example, two or more spaced-out claws can be provided on the lift-off device, on which claws the door rests by means of correspondingly shaped supports. The lift-off device not only moves the door in the direction of the longitudinal axis of the oven chamber but can also raise and lower the door between a bottom and a top position.

In the case of automatic lift-off devices, which automatically draw the door out of the oven chamber or insert it into the latter, it is necessary to ensure that the door can be lifted out by the lift-off device in a particular, slightly raised position which is centered relative to the door aperture of the oven chamber, and can also automatically be reinserted at the same height into the door aperture. Since the dimensional tolerances between the external dimensions of the door and the internal dimensions of the door aperture of the oven chamber are relatively small, it is important that the door should be raised, within the door aperture of the oven chamber, by an initial amount which always remains the same and can be predetermined precisely.

Usually, the door which has been drawn out of the door aperture is brought, by means of the lift-off device, into a cleaning position, the level of which differs from the level of the door aperture. Here again, it is necessary to ensure that the door can be brought back to exactly the same initial level.

It is an object of the invention to provide a lift-off device by means of which the doors of oven chambers can be lifted out in a slightly raised position which is centered relative to the door aperture, and can automatically be reinserted at the same level even if the position of the liftedout door has been changed.

Starting from the lift-off device which has been explained in more detail initially, this object is achieved, according to the invention, by an arrangement wherein two counters are coupled to a pulse generator which generates pulses as a function of the raising movement of the lift-off claws, of which the first counter controls the raising of the door within the oven and for this purpose, when a switch which detects the engagement of the lift-off claws is actuated, counts a number of pulses which can be preselected and corresponds to a constant preliminary raising movement of the lift-off claws, whilst the second counter is constructed as a forward-backward counter, which counts the pulses between the upper position of the preliminary raising movement and a cleaning position, located above it and determined by a limit switch circuit breaker, forwards or backwards depending on the direction of movement of the lift-off claws, and limits the lowering movement of the lift-off claws from the cleaning position into the upper position of the preliminary raising movement.

Since the first counter only counts the pulses of the pulse generator after the switch which detects the engagement of the lift-off claws has been actuated, the length of the preliminary raising movement is independent of the point of engagement of the claws on the oven doors. Changes in the points of engagement of the lift-off claws, for example, by soiling, can in this way be compensated automatically. In addition, the length of the preliminary lifting movement can, without problems, be adjusted in small steps by a suitable choice of the preset counter position. The first counter, after counting the preset number of pulses, provides a signal which controls the further movement of the lift-off claws and switches off the raising movement. For example, this signal can initiate the extraction movement of the lift-off claws.

The second counter counts pulses when the lift-off claws, after having drawn the door out of the door aperture of the oven chamber, execute a further raising movement. Starting from an initial value, for example, the zero reading of the counter, the second counter adds the pulses of the pulse generator when the lift-off claws are raised. The limit switch terminates the raising movement of the lift-off claws. During the subsequent lowering movement the second counter counts backwards. It subtracts the pulses of the pulse generator from the counter reading which has been added up during the preceding raising movement, until it has again reached the initial value, that is to say the zero reading of the counter. The door is then in the correct position for insertion into the oven chamber.

The lowering movement of the lift-off claws, with the door inserted into the oven chamber, could be terminated, for example, by a lower limit switch circuit breaker. However, in a preferred embodiment the first counter also controls the lowering movement of the door within the oven in accordance with the preset counter reading.

The first counter could be an upwards counter, which adds the pulses of the pulse generator until a gate circuit connected to the counter detects the preset number of pulses. However, simpler embodiments are achieved if the first counter is constructed as a presettable backwards counter, which subtracts the pulses of the pulse generator from the preset counter reading. The preset number of pulses is reached when the first counter has counted backwards to "0."

It has also proved advantageous if the first counter can be preset to the counter reading corresponding to the preliminary raising movement by means of switch contacts of a drive device which moves the lift-off claws after completion of the preliminary raising movement. In this case, the generally cyclic sequence of movement of the lift-off claws is utilized. In the same way, a defined starting position of the second counter can also be predetermined if this second counter can be set to zero by means of switch contacts of a drive device which moves the lift-off claws after the upper position of the preliminary raising movement has been reached.

The invention is particularly suitable for lift-off devices in which the lift-off claws are held on a carrier which can be pivoted about a vertical axis between the door lifting-off and inserting position and the cleaning position.

Figure 2:
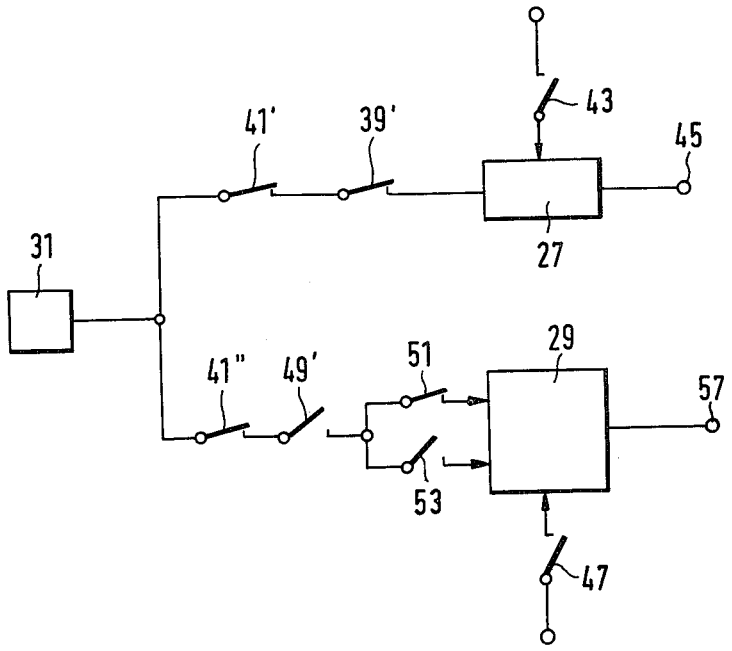

The invention is explained in more detail below with the aid of drawing in which:

FIG. 1 shows a schematic side view of an illustrative embodiment of the lift-off device according to the invention, with the door drawn out of the oven chamber of a coke oven; and FIG. 2 shows a schematic block circuit diagram of a control unit suitable for the lift-off device according to FIG. 1.

FIG. 1 shows an oven chamber 1 of a coke oven possessing several horizontal chambers, the door aperture 3 of this chamber being closable by means of an oven door 5 which is not hinged to the oven chamber 1. The door 5 engages in the oven chamber 1 and can, by means of a lift-off device, be raised from, and drawn out of, its position which is centered relative to the door aperture 3, and can also be inserted, and lowered into, the said position.

The lift-off device rests on a carriage 13 which is provided with rollers 7 and can be moved by means of a drive device 9, for example, a hydraulic cylinder, along rails 11 in the direction of the longitudinal axis of the oven chamber 1. On its outer side, the door 5 carries at least two bearing blocks 15 which are vertically spaced apart from one another, and by means of which the door rests on the claws 17 of a carrier 21, which is vertically displaceable by means of rollers 23 along rails 19 of the carriage 13. The carrier 21 is moved by a drive device 25, for example, a hydraulic cylinder. Furthermore, the carrier 21 can be pivoted about a vertical axis which is not shown, so that after having been drawn out of the oven chamber 1, the door 5 can be pivoted into its cleaning position.

The movement of the lift-off device when drawing out or inserting the door 5 is controlled by two counters 27, 29, which count the pulses generated by a pulse generator 31 as a function of the vertical raising movement of the carrier 21 and hence of the lift-off claws 17. In the present instance, the pulse generator 31 is constructed as a magnetic switch 33, which responds to changes in the field of a magnet 38 which is coupled via a pinion 35 to a rack 37. The pulse generator 31 provides a predetermined number of pulses per unit length of the raising movement of the carrier 21. Accordingly, the reading of the counters 27 and 29 is proportional to the vertical position of the lift-off claws 17 and of the door 5 resting on the lift-off claws 17.

The counters 27 and 29 permit automatic opening and closing of the door 5, for which the door 5 can be raised by a predetermined amount within the door aperture 3 and can, at this level, be drawn out of the door aperture 3 or inserted into the said aperture.

A suitable circuit for this purpose is shown in FIG. 2. The circuit will be explained in conjunction with the mode of operation of the lift-off device according to FIG. 1.

To open the door 5, the carriage 13 is moved forwards, with the carrier 21 lowered, until a limit switch 39, which responds in the frontmost position, switches off the drive device 9. In the frontmost position of the carrier 13, the lift-off claws 17 are immediately below the bearing blocks 15 of the door 5. Furthermore, the limit switch 39 makes a contact 39' in the line connecting the pulse generator 31 to the counter 27. In this connecting line, as well as in the connecting line to the counter 29, there are provided switch contacts 41' and 41'', respectively, of a switch 41, which is actuated when the bearing blocks 15 engage in the claws 17, and closes the contacts 41' and 41''. During the subsequent raising movement, the pulses of the pulse generator 31 reach the counter 27.

The counter 27 is constructed as a presettable backwards counter, which can be preset to a predetermined counter reading by means of a switch contact 43 which can, for example, be actuated by the drive device 9 during the preceding forward movement. The presettable counter reading corresponds to a position of the door 5, at the end of the preliminary raising movement, in which it has been raised relative to the position where it is centered with regard to the door aperture 3, and in which it can be drawn out of the door aperture 3. The counter reading of the counter 27 has been counted back to "0" on reaching the position corresponding to the preliminary raising movement and provides a signal, at its output 45, by means of which, for example, the raising movement is switched off and the drawing-out movement can be initiated.

After drawing out of the door aperture 3, the door 5 is raised further when being transferred into the cleaning position. The length of the subsequent raising movement is determined, and stored by the counter 29. By means of this counter 29 the door 5 can, during the subsequent closing, again be lowered to the defined position which it occupied, at the end of the preliminary raising movement, during drawing-out. The counter 29 is constructed as a forward-backward counter, which after reaching the position at the end of the preliminary raising movement is set to zero, for example, by means of a switch contact 47 which is actuated by the drive device 9 during the drawing-out movement. The further raising movement of the lift-off device starts after reaching the cleaning position, which is detected by a limit switch 49. In the cleaning position, a switch contact 49' of the limit switch 49, located in the connecting line between the pulse generator 31 and the counter 29, is closed. The pulses of the pulse generator 31 are fed to the counter 29 via alternately open and closed switch contacts 51, 53, which are actuated together with the drive device 25. During the raising movement, the switch contact 59 connected to the forward input is closed, so that the counter 29 adds the pulses of the pulse generator 31. A limit switch 55 terminates the further raising movement. During the subsequently lowering, the switch contact 53 is closed and the counter 29 subtracts the pulses of the pulse generator 31 from the number of pulses counted during the raising movement. On reaching the position corresponding to the end of the preliminary raising movement, the counter 29 has run back to "0" and provides, at its output 57, a signal which initiates the forward movement of the carriage 13 for inserting the door 5. At the same time the counter 29, in position "0," switches off the downward movement.

In the position corresponding to the end of the preliminary raising movement, the door 5 is inserted into the door aperture 3, and this is detected by the limit switch 39. After locking the door 5, the carrier 21 is lowered further until the claws 17 release the supports 15. A further limit switch 59 terminates this lowering movement of the carrier 21. The lowering movement can, however, also be controlled by the counter 27 if the latter is preset, before the start of the lowering movement, for example, during the insertion of the door 5, to the counter reading corresponding to the position at the end of the preliminary raising movement, and then counts pulses from the pulse generator 31 backwards.

It is, of course, intended to cover by the appended claims all such modifications which fall within the true spirit and scope of the invention.

What is claimed is:

1. A lift-off system for the doors of oven chambers of a horizontal chamber coke oven having handles that can be raised and lowered between a bottom and a top terminal position and can be moved, in an intermediate engagement position, in the direction of the longitudinal axis of the oven chambers comprising door positioning means for opening and closing a door and for raising and lowering same into and out of a cleaning position, first and second counters coupled to a pulse generator constructed and arranged to generate pulses as a function of the raising movement of the door, first switch means responsive to the movement of the door, said first counter responsive to the movement of said switch to control the raising of the door by counting the number of pulses which can be preselected and corresponds to a constant preliminary raising movement of the door handles, second switch means located above said door, said second counter being constructed as a forward-backward counter, which counts the pulses between the upper position of the preliminary raising movement and a cleaning position, located above it and determined by said second switch means, said counter counting forwards or backwards depending on the direction of movement of the door handles, and limiting the lowering movement of the door from the cleaning position into the upper position of the preliminary raising movement.

2. A lift-off device as claimed in claim 1, wherein the first counter also controls the lowering movement of the door within the oven, in accordance with the preset counter reading.

3. A lift-off device as claimed in claim 1 wherein the first counter is constructed as a presettable counter, which subtracts the pulses of the pulse generator from the preset counter reading.

4. A lift-off device as claimed in claim 3 including switch means responsive to the movement of said door positioning means which moves the lift-off handles before the start of the preliminary raising movement and said first counter being preset to the counter reading corresponding to the preliminary raising movement of the door by said switch means.

5. A lift-off device as claimed in claim 1 including switch means responsive to the movement of said door positioning means which moves the lift-off handles after the upper position of the preliminary raising movement has been reached and said second counter being set to zero after the upper position of the preliminary raising movement has been reached.

6. A lift-off device in accordance with claim 1 in which the door positioning means includes a pivotally mounted carrier on which there are located lift-off claws for engaging the handles of the door for moving the door into various positions.

* * * * *